US008028417B1

(12) United States Patent
Hosseini et al.

(10) Patent No.: US 8,028,417 B1
(45) Date of Patent: Oct. 4, 2011

(54) APPLICATOR HEAD

(75) Inventors: Bijan Hosseini, Newport Beach, CA (US); Scott Haynes Stevenson, Newport Beach, CA (US)

(73) Assignee: HandsFree Marketing, Inc., Huntington Beach, CA (US)

( * ) Notice: Subject to any disclaimer, the term of this patent is extended or adjusted under 35 U.S.C. 154(b) by 448 days.

(21) Appl. No.: 11/412,054

(22) Filed: Apr. 26, 2006

Related U.S. Application Data

(63) Continuation of application No. 10/816,790, filed on Apr. 2, 2004, now abandoned.

(60) Provisional application No. 60/461,357, filed on Apr. 8, 2003.

(51) Int. Cl.
*B65D 35/36* (2006.01)
*B65D 35/24* (2006.01)

(52) U.S. Cl. ..... 30/41; 30/92; 222/191; 222/575

(58) Field of Classification Search ..... 30/92, 41, 30/41.5, 535, 538, 123; 222/191, 575
See application file for complete search history.

(56) References Cited

U.S. PATENT DOCUMENTS

| | | | | | |
|---|---|---|---|---|---|
| 1,433,167 | A | * | 10/1922 | Worden | 222/105 |
| 1,581,563 | A | | 4/1926 | Brown | |
| 1,673,590 | A | * | 6/1928 | Redheffer | 30/41 |
| 1,878,475 | A | * | 9/1932 | Driest | 30/41 |
| 1,949,976 | A | | 3/1934 | Runnels | |
| 1,977,529 | A | * | 10/1934 | Schaanning | 30/537 |
| 3,135,007 | A | | 6/1964 | Howell | |
| 3,226,762 | A | | 1/1966 | Norman | |
| 3,356,441 | A | | 12/1967 | Schwartzman | |
| 3,756,732 | A | | 9/1973 | Stoffler | |
| 4,027,985 | A | * | 6/1977 | Loesser, III | 401/134 |
| 4,446,965 | A | | 5/1984 | Montiel | |
| D281,282 | S | * | 11/1985 | Lazarus | D28/47 |
| 4,817,229 | A | * | 4/1989 | Sedillo | 15/245.1 |
| 4,964,372 | A | | 10/1990 | Zeeni et al. | |
| 5,054,503 | A | | 10/1991 | Keller | |
| 5,269,062 | A | * | 12/1993 | Dallaire et al. | 30/41 |
| 5,638,990 | A | * | 6/1997 | Kastberg | 222/106 |
| 5,649,859 | A | | 7/1997 | Shiga | |
| D426,917 | S | * | 6/2000 | Hokanson | D28/45 |
| 6,754,958 | B2 | * | 6/2004 | Haws et al. | 30/41 |
| 6,789,321 | B2 | * | 9/2004 | Simms | 30/41 |

FOREIGN PATENT DOCUMENTS

| | | |
|---|---|---|
| BE | 551938 | 11/1956 |
| DE | 1814434 | 12/1968 |
| DE | 8708597 | 8/1987 |
| DE | 3938347 | 11/1989 |
| GB | 497464 | 12/1938 |
| GB | 618650 | 2/1949 |
| GB | 742615 | 12/1955 |
| GB | 857968 | 1/1961 |
| IT | 602402 | 2/1960 |
| NL | 6805429 | 10/1969 |

* cited by examiner

*Primary Examiner* — Ghassem Alie
(74) *Attorney, Agent, or Firm* — Novel IP

(57) ABSTRACT

The present invention is directed toward a tool holder for a flexible tube that contains a composition used in connection with the tool. The tool holder has a frame adapted to be secured the sealed end of the flexible tube and a tool portion having a tool such as a razor blade, a brush, a cosmetic scraper blade, a planar scraper blade, a massager head, sandpaper, polishing, and the like.

20 Claims, 12 Drawing Sheets

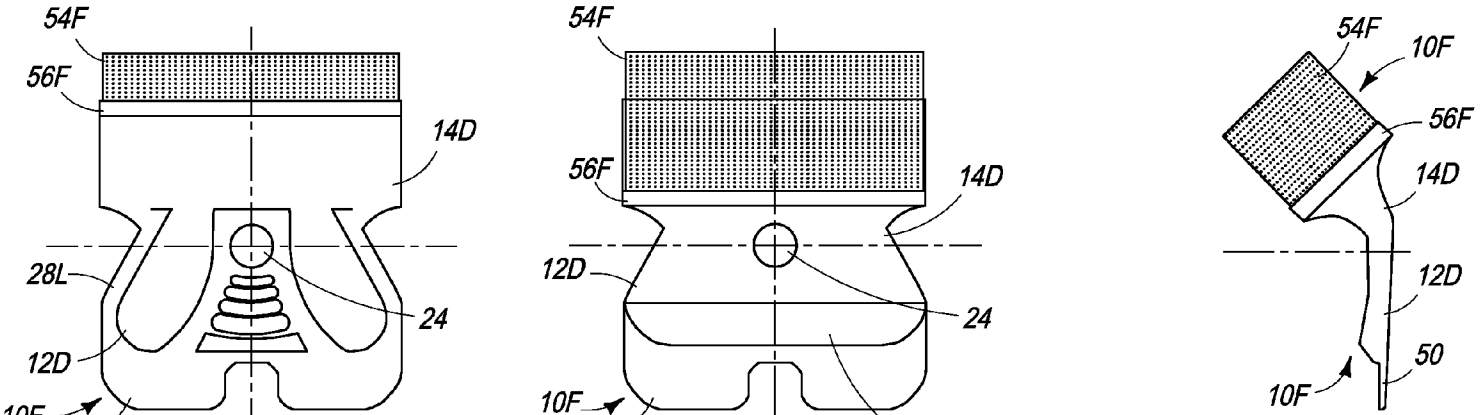
FIG. 28
FIG. 29
FIG. 30
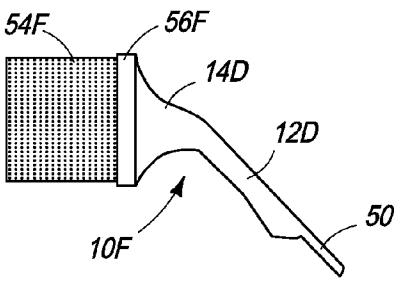
FIG. 32
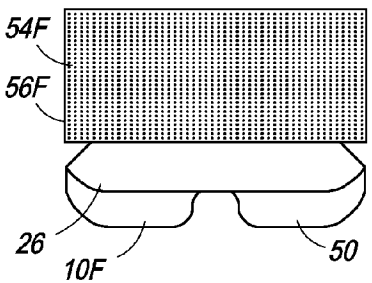
FIG. 31

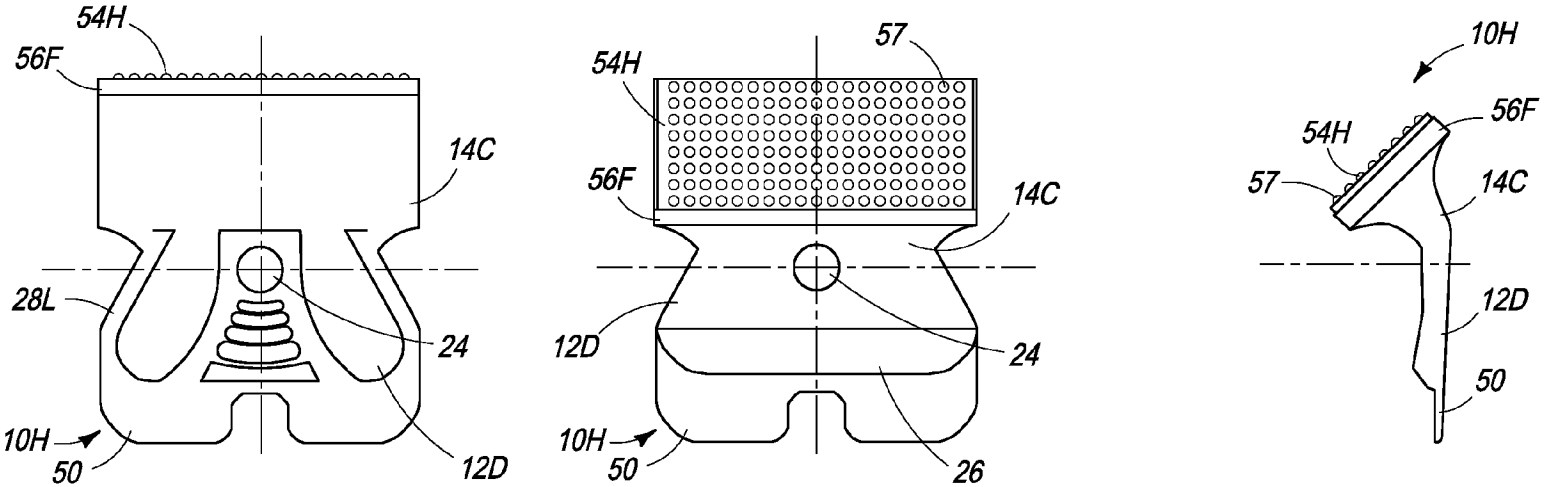
FIG. 40
FIG. 39
FIG. 38
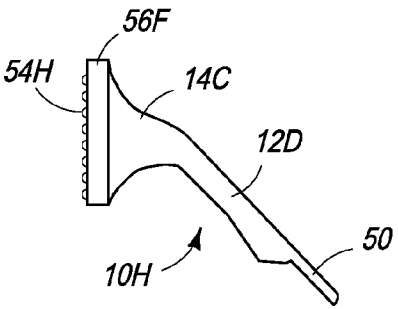
FIG. 42
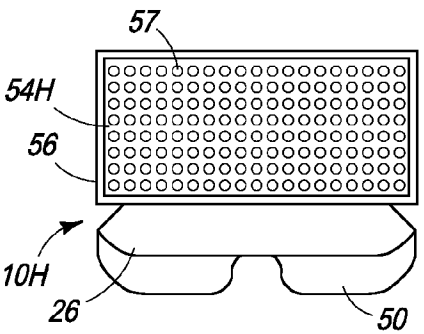
FIG. 41

APPLICATOR HEAD

This patent application is a continuation of U.S. patent application Ser. No. 10/816,790 filed Apr. 2, 2004 now abandoned, which claims the benefit of U.S. Provisional Application No. 60/461,357 filed Apr. 8, 2003.

FIELD OF THE INVENTION

The present invention is directed to a new and improved tool or implement holder, such as for a razor, employing a semi-rigid or flexible tube containing a composition, such as shaving cream, that works in association with the tool or implement, such as a razor blade attachment at the end of the tube which can receive and detachably secure a razor blade. The body of the tube serves as a handle for the tool or implement.

BACKGROUND OF THE INVENTION

There are many implements or tools used today that are used in association with a composition; and there are many compositions in use today that require or are preferably used with a tool or implement. For example, depilatories are normally used in conjunction with a scraper. Depilatory composition is applied to the area of interest, the depilatory composition is allowed to set for a set period of time, and then the composition, together with the depilated hair, is removed employing a scraper. Similarly, compositions used to clean spots off of clothes or off fabrics or from rugs are applied to the soiled area, allowed to work in the soiled area to perform their action, and frequently the composition is worked into or rubbed in, or rubbed with a brush before removal to enhance cleaning. Grouting compositions that are used to grout cracks or holes in surfaces, such as walls or ceilings, are applied to fill the crack or hole and then a blade is applied to smooth the grout so that it is even with the surface surrounding the hole or crack. Massage lotions are applied to the skin and then the massaging implement is worked over the skin with the lotion acting as a lubricant as well as performing other functions depending upon the composition of the lotion. Compositions are available for removing paint from surfaces, such as mirrors and windows. Compositions are available to soften materials to remove labels, and the like. The softening composition is applied to the surface of the material or to the label to act upon it, the composition is allowed to work on the material for a period of time, and then it is scraped off employing a planar scraper blade which can have a knife-edge or blunt edge with sharp 90-degree corners.

Paint, ink, coatings, waxes, and protective coatings are applied to an area frequently using a sponge. Some paint removers and polishers are applied to a surface and then after they have acted upon the surface, they are rubbed with sandpaper or a very fine polishing surface to either remove the paint or coating or to polish the surface.

Razors have traditionally comprised a frame with a fixed razor blade or a razor blade holder which is used to removably secure razor blades. Razors have been in use for over a century. The handle is normally elongated and shaped somewhat like a toothbrush handle. The head of the razors for replaceable razor blades is adapted to receive the particular type of razor blade that it is designed for. Although there are razor blades that can be received on a universal head, many razor blades can only be received on a proprietary head.

Shaving lotions come in cans, flexible tubes, semi-rigid tubes and in soap cakes. Shaving lather is normally applied to the skin when the skin is wetted. Preferably the skin has been prewashed to remove facial oils and bacteria. Earliest shaving lathers were lathered up from soft caked soap placed in the bottom of a mug, wetted with water and then lathered up with a brush. The brush applied the lather to the face. Shaving lather caked soap is still available. In the 1930's, prepared lather creams started to appear. These lather creams were sold in flexible tubes, tubes similar to toothpaste tubes. The tubes were originally made from tin or lead or alloys thereof. Later tubes were made of aluminum. Today the tubes are made from plastic. Some lather creams were meant to be applied to a wet face directly with the hands or fingers. Other lather creams were made to be applied with a brush. These types of shaving lather creams are still available. In the 1960's, shaving foams became available in pressurized cans wherein the lather foam was released from the can by pressing the relief valve. The lather foam was released as a foaming mass which was applied to the face typically with the fingers and hands. This is the most common form of shaving lather used today.

With regard to volume and size, the cake soap shaving lather requires less room, but it also requires a container, such as a mug, and a brush to utilize. Volumetrically, the shaving lathers that are available in aerosol cans require the most space and can be applied with the hands and fingers making them easy to use. Shaving lather creams available in tubes are easy to apply with the hands and fingers and require less than half the space of shaving lathers supplied in aerosol cans and work equally as well. They do not require a mug or brush.

Many women prefer to shave body hair in the bathtub or in the shower, and many men prefer to shave their beards in the shower. The bath and shower are not convenient for the use of the cake soap shaving lather with mug and brush. If the mug is dropped, it can break since they are normally made of ceramic material showering sharp particles. In addition, the mug can chip the bathtub or shower tile The aerosol can has a disadvantage that if it is kept in the shower or around the tub, it gets wet and the metal of the aerosol rust causing rust stains in tile grout and the like. In addition, if the can is dropped, it can chip the bathtub or shower tile. Thus, when shaving in the bathtub or in the shower, shaving lather cream that is contained within a flexible tube is preferred because a flexible tube is normally nonmetallic and can be dropped without breakage or chipping and can be left in or around the tub or shower without causing rust stains. The flexible tube of shaving cream is more convenient for travel because it requires less space than aerosol cans and does not require the use of a mug or brush for application.

One of the problems that is encountered by people when traveling is the amount of space required for their shaving gear including the razor blade with its frame and the shaving lather source, whether it is soap cake shaving lather applied with a brush or shaving lather applied from a flexible tube or shaving lather applied from an aerosol can. Another problem is that when people shave around the bathtub or shower, the separate components, the razor blade with handle and the source of the shaving cream, take up space which is normally in a premium around a bathtub or in a shower stall.

Thus, there is a need and there has been a need for a single unit shaving device which contains the shaving lather as well as functioning as a frame, support and handle for the razor blade.

Many compositions, such as shaving cream, cleaning preparations, and the like, are thick or gelatinous materials that cannot easily be removed from a rigid bottle. These compositions are more easily applied from a flexible container having flexible or semi-rigid walls, such as a toothpaste tube.

Many compositions are supplied in flexible tubes with a separate tool or implement for use. The tube and tool or implement frequently get separated, and thus when the user wants to use the composition, they cannot find the implement or tool or vice versa. In addition, because of the relatively low cost for many compositions, tools are made cheaply and skimpily and do not have an adequate handle. It is an object of the present invention to provide a flexible tube having flexible or semi-rigid walls for dispensing a composition for use and the implement or tools being secured to the flexible tube so that the implement or tool cannot be separated from the composition and the flexible tube can function as a large handle so that the implement or tool can be comfortably held and worked.

SUMMARY OF INVENTION

The present invention is directed to an improved razor for supporting and holding a razor blade and containing the shaving lather. The present invention comprises a semi-rigid flexible tube, such as the tubes disclosed in U.S. Pat. Nos. 5,871,020 and 6,053,184, which has secured to the end thereof a razor blade attachment unit. The razor blade attachment unit can have a razor blade attachment plate of the universal type which can receive and detachably secure many of the razor blades produced by a number of companies or it can be an attachment unit that has been designed specifically for a particular razor blade. There are several proprietary razor blades that are produced which can only be received by a particular type or proprietary razor blade attachment assembly.

The present invention is also directed to a tool holder for a flexible tube comprising a frame adapted to be secured to the sealed end of the flexible tube, the frame having an attachment portion and a tool portion, the attachment portion having a first surface adapted to generally mate with the portion of the sealed end of the flexible tube, the tool portion having a tool holder adapted to receive a tool. The first surface can be adapted to be affixed to the sealed end of the tube by sonic or heating welding, or by adhesion, or by a friction fit. The tube holder can have at least one bore extending through the frame of the tool holder which is in registration with a bore through the sealed end. In one embodiment, a fastener, such as a rivet, is passed and secured through one or more bores of the frame and through bores in registration of the sealed end to secure the tool holder to the sealed end of the tube. In one embodiment of the invention, a tool holder is adapted to permanently receive a tool. In an alternative embodiment of the present invention, a tool holder is adapted to removably receive a tool so the tool can be attached for use and removed. A tool can be a razor blade cartridge which is received on the tool holder. A tool can be a brush which is affixed to the tool holder. A tool holder can be a cosmetic scraper which is roughly right angles to the main plane of the tool holder and the longitudinal axis of the flexible tube. The tool holder can be a stiff planar blade scraper extending roughly out in the main plane of the tool holder and parallel to or intersecting the longitudinal axis of the flexible tube. The scraper has a knife-edge or blunt edge with sharp corners. The tool holder can be a flexible planar blade extending roughly out in the main plane of the tool holder and parallel to or intersecting the longitudinal axis of the flexible tube and adapted to apply and smooth grouting. The tool can be a massager head affixed to the tool holder having a surface with protrusion extending therefrom for massaging tissue. The tool can be a brush or sponge affixed to the tool to spread, or smooth, or coat a surface with paint, ink, coatings, waxes, polishes, protective coatings, and the like to a surface. The tool can be a curved or planar support plate adapted to receive sandpaper which can be secured by an adhesive, or to a polishing pad comprising a soft fabric-like material which can be secured by an adhesive.

When the tool is a sponge, massager head, sandpaper device or polishing device with a polishing pad, the working surface of the brush, sponge, massager head, sandpaper and polishing pad are angled from the main plane of the tool holder and the longitudinal axis of the flexible tube normally about 45 degrees plus/minus 15 degrees. However, the working surface can be angled up to 90 degrees from the main plane of the tool holder and the longitudinal axis of the flexible tube. The longitudinal axis of the flexible tube is parallel to or lies in the main plane of the tool holder.

The alternative embodiment of the present invention comprises an implement holder and a flexible tube handle, the flexible handle comprising a flexible tube having semi-rigid or flexible walls. The tube holder comprises a frame adapted to be secured to the sealed end of the flexible tube, the frame having an attachment portion and a tool portion, the attachment portion having a first surface adapted to generally mate with a portion of the sealed end of the flexible tube, the tool portion having a tube holder adapted to receive a tool or having a tool affixed thereto. In one embodiment, the first surface is affixed to the sealed end of the flexible tube. In another embodiment, the frame of the tool holder is secured to the flexible tube by a fastener[s], such as a rivet[s]. The tool portion can be a razor blade cartridge, it can be a brush, it can be a stiff planar blade scraper, it can be a cosmetic scraper, it can be a flexible planar blade grouter, it can be massager head, it can be a support plate with a planar or curved surface adapted to hold sandpaper, emery cloth, or a polishing pad, and the like. The flexible tube is adapted to receive a composition to be used in association with the tool and is dispensed from the flexible tube from the applicator end opposite the sealed end.

In one embodiment of the present invention, the invention is a shaver comprising a tool holder for a flexible tube adapted to contain shaving cream used in connection with the shaver. In another embodiment of the present invention, the invention is a cleaning device comprising a tool holder for a cleaning implement, such as a brush, and a flexible tube adapted to receive cleaning compositions which are used in connection with the cleaning implement. In another embodiment of the present invention, the invention is a scraping device comprising a tool holder for a scraper, and a flexible tube adapted to contain compositions for removal or softening of materials from surfaces used in conjunction with the scraper device. The compositions for removal of materials from surfaces can be paint removers, softening compositions for removing adhesive materials, hydrocarbon or halogenated compositions for removal of tar, oil and greases from surfaces, and the like.

In another embodiment of the present invention, the invention is directed to a caulking device comprising a tool holder for a caulking blade, and a flexible tube adapted to contain caulking composition used in connection with the caulking blade. The caulking blade is normally a flexible planar blade used for applying caulking to cracks and holes and for smoothing the caulking so that the surface of the caulking material is contiguous with the surface surrounding the crack or hole.

In another embodiment of the invention, the invention is directed to a cosmetic scraper comprising a tool holder for a cosmetic scraper, and a flexible tube adapted to contain depilatory compositions for the removal of hair from skin, which is used in connection with the cosmetic scraper.

In another embodiment of the invention, the invention is directed to a massager comprising a tool holder for a flexible tube adapted to contain massage lotions used in connection with the massager.

In another embodiment of the invention, the invention is directed to a device comprising a tool holder for a flexible tube adapted to contain paint, ink, coatings, waxes, polishes, protective coatings and other coatings used in connection with a sponge secured to the tool. The sponge can be secured to the tool holder with an adhesive backing so that the sponge can be replaced with fresh sponges as the need arises.

In still another embodiment of the present invention, the invention is directed to a device comprising a tool holder for a flexible tube and adapted to contain paint remover or polish used in conjunction with sandpaper or a polisher pad secured to the tool holder. Preferably, the sandpaper or polishing pad is secured to the tool holder with self-adhesive backing so that the sandpaper or polishing pad can be removed and replaced as the need arises.

BRIEF DESCRIPTION OF THE DRAWING

FIG. 28 is a front plan view of a sponge attachment unit of the present invention;

FIG. 29 is a back plan view of the sponge attachment unit of FIG. 28;

FIG. 30 is a left plan side view of the sponge attachment unit of FIG. 28;

FIG. 31 is a top view looking into the sponge head of FIG. 30;

FIG. 32 is another left plan side view of the sponge attachment unit of FIG. 28;

FIG. 38 is a front plan view of a massager attachment unit of the present invention;

FIG. 39 is a back plan view of the massager attachment unit of FIG. 38;

FIG. 40 is a left plan side view of the massager attachment unit of FIG. 38;

FIG. 41 is a top view of looking into a massaging head of FIG. 40;

FIG. 42 is another left plan side view of the massager attachment unit of FIG. 38;

DETAILED DESCRIPTION OF THE INVENTION

Figure 3:
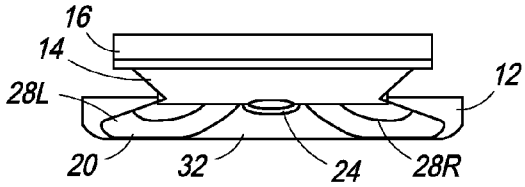
FIG. 3 is a top view of the unit of FIG. 1.
Figure 5:
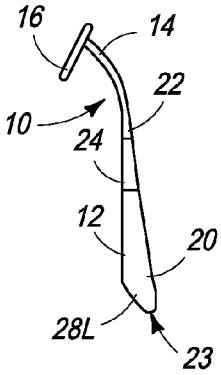
FIG. 5 is a left plan side view of the unit of FIG. 1.
Figure 1:
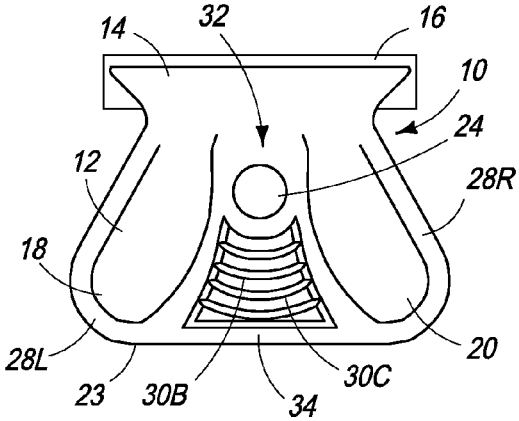
FIG. 1 is a front plan view of the razor blade attachment unit of the present invention.
Figure 6:
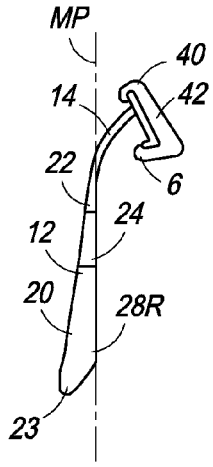
FIG. 6 is a right side plan view of the unit of FIG. 1 with a razor blade attached.
Figure 4:
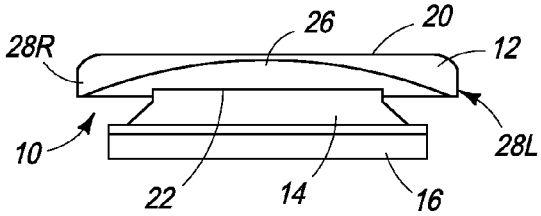
FIG. 4 is a bottom view of the unit of FIG. 1.
Figure 2:
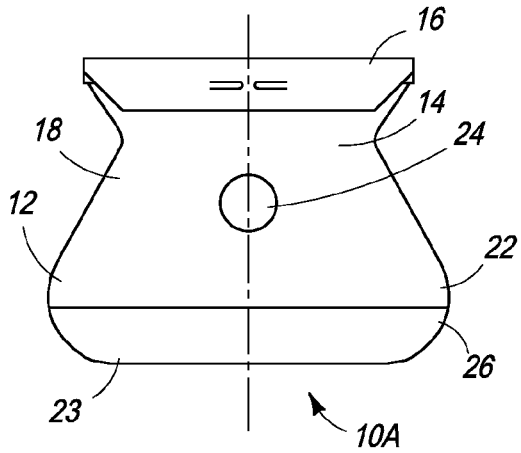
FIG. 2 is a back plan view of the unit of FIG. 1.
Figure 7:
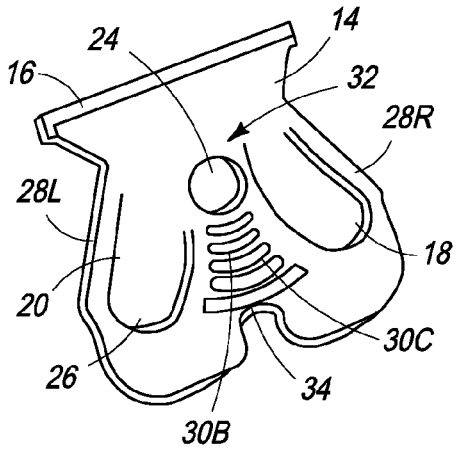
FIG. 7 is a left perspective view of the front side of the unit of FIG. 1.
Figure 8:
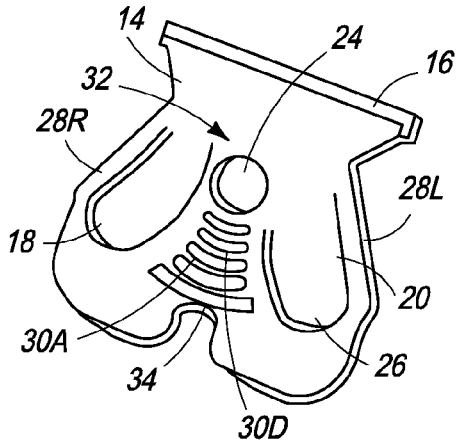
FIG. 8 is a right perspective view of the front side of the unit of FIG. 1.

Referring to FIGS. 1-8, the razor blade attachment unit 10 comprises a frame 12 having an arm 14 extending upwardly and outwardly therefrom and a razor blade attachment plate 16 secured to the end of the arm 14. Alternatively, a proprietary razor blade attachment assembly can be used (not shown). The razor blade attachment plate 16 can be a universal attachment plate which will receive most razor blades manufactured today. However, some razor blades cannot be secured by the universal attachment plate and the proprietary attachment assembly must be used for the attachment of such blades if they are to be used.

The frame 12 has a ribbed front side 20 and a planar back side 22. A hole 24 extends through the frame from the ribbed front side to the planar back side adapted to receive a hanger to support the razor or a fastener, such as a rivet, to secure the frame to the sealed end or flexible tube. The ribbed front side 20 has a pair of U-shaped ribs 28R and 28L on the right side and left side, respectively, of the frame that extend downwardly from the outer ends of the arm to the bottom of the frame where they curve in a U-shaped manner and extend upwardly again where they join to form a platform 32 which is connected to the arm 14. The frame 12 has a planar wall 18 which is recessed with respect to the front of the U-shaped ribs. The back side of the planar wall 18 defines the planar back side 22. On the planar back side 22 at the base 23 of the frame 12, the surface of the back side is cut inwardly to form an arcuate scalloped wall portion 26. This portion is scalloped to receive the bulging wall of the shaving cream semi-rigid tube. The use of the ribs in conjunction with the planar wall provides a frame that is strong and light weight and minimizes the use of materials and is yet rigid enough to perform the desired function.

To both reinforce the razor blade attachment unit 10 and to add a decorative feature to the unit, portions of the U-shaped ribs are stiffened and reinforced with respect to each other by the platform 32 and with a series of arcuate ribs 30A through 30D. At the base of the frame 12, a base rib 34 extends from the base of the U-shaped ribs to further stiffen and reinforce the unit. The frame 12 is relatively rigid or stiff because of the planar wall 18, the U-shaped ribs 28R and 28L, and arcuate ribs 30A through 30D, and the base rib 34. The arm 14, being a curved sheet-like structure has a limited degree of flexibility to assist the attached razor blade (see FIG. 6) to follow the contour of the skin during shaving.

Figure 9:
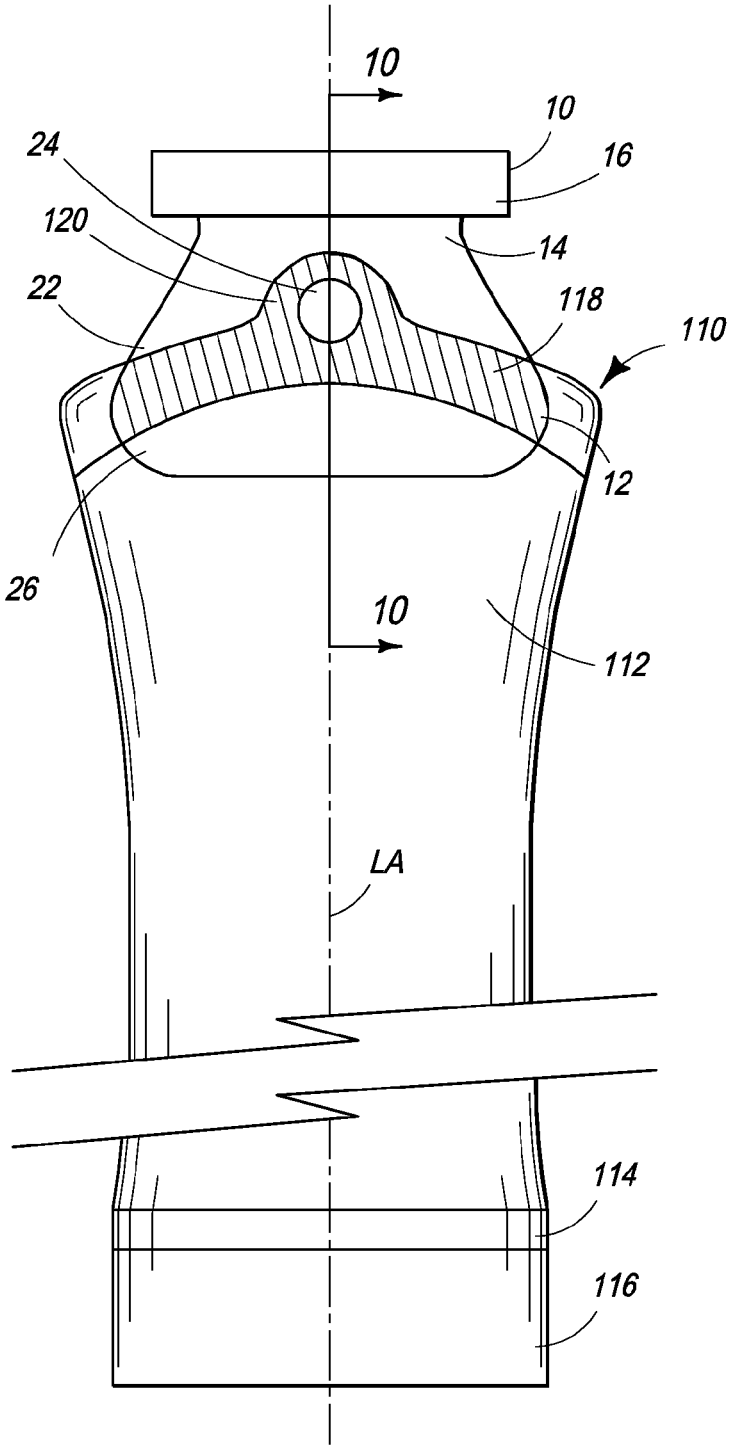
FIG. 9 is a back plan view of the razor of the present invention.
Figure 10:
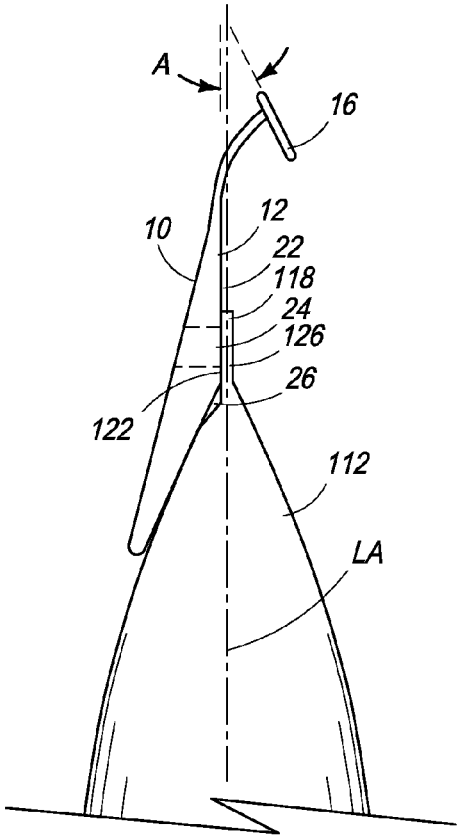
FIG. 10 is an enlarged fragmentary plan side view of the end portion of the razor taken along lines 10-10 of FIG. 9.
Figure 47:
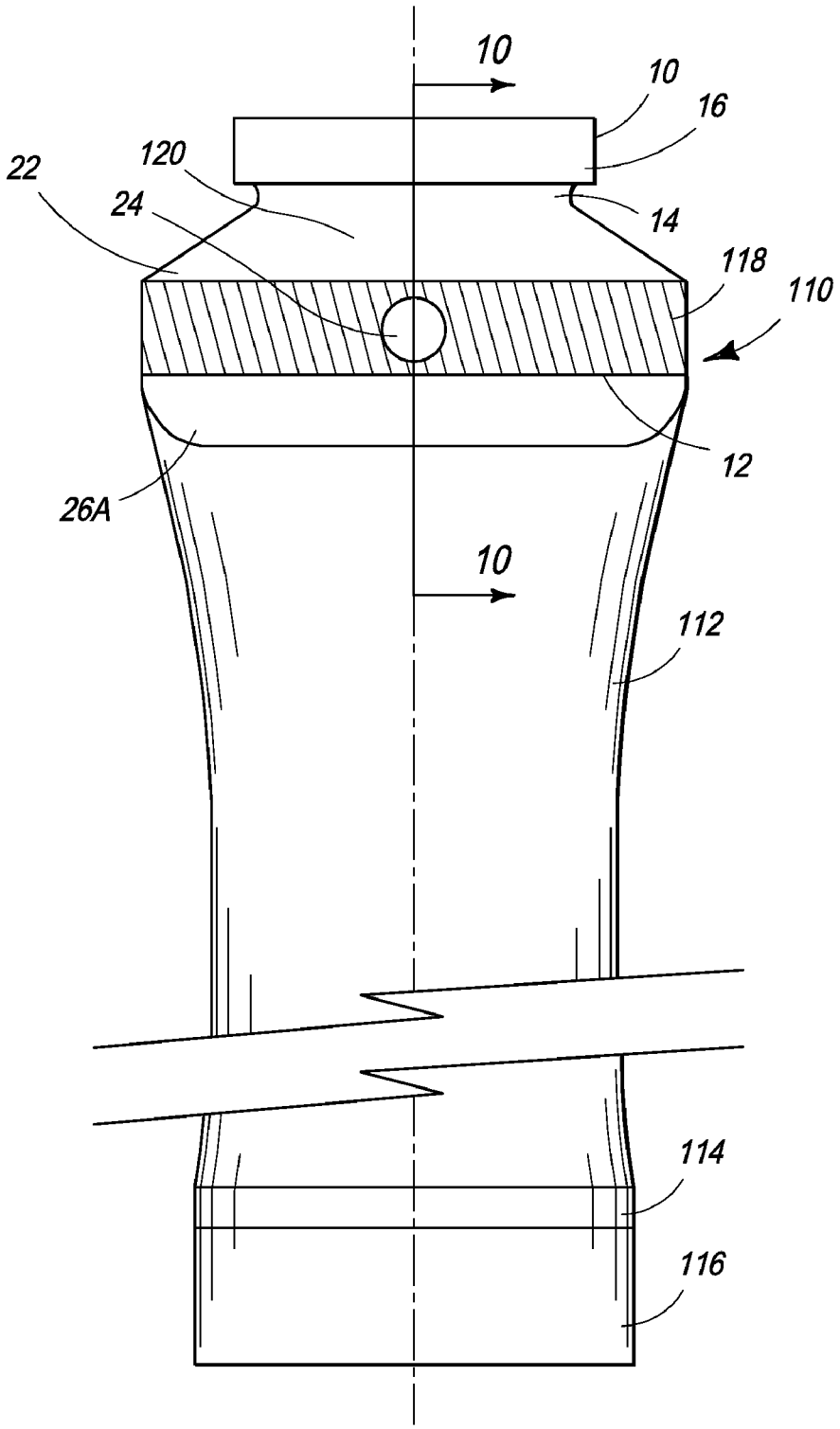
FIG. 47 is a back plan view of another embodiment of the present invention.

Referring to FIGS. 9 and 10, the razor blade of the present invention comprises the razor blade attachment unit 10 and the semi-rigid tube 112. The flexible or semi-rigid tube 112 conveniently contains shaving cream which can be forced out of the flexible tube through the applicator head 114 and 116. The shaving cream can be applied to the face employing the applicator head. This eliminates the need to use the hands or fingers for application of the shaving cream. The applicator heads are described in U.S. Pat. Nos. 5,871,020 and 6,053,184, the disclosures for which are incorporated herein by reference. The invention is not limited to flexible tubes having applicator heads. Flexible tubes with conventional heads, such as seen on toothpaste tubes, shaving cream tubes, etc., can be used. The end of the flexible or semi-rigid tube 112 is sealed to form an end seal 118. The end seal can be arcuate as seen in FIG. 9 and adapted to mate with arcuate scallop wall portion 26 of razor blade attachment unit 10. However, the end seal can also be nonarcuate, that is straight, as seen in FIG. 47. This is adapted to mate with a nonarcuate or straight scallop wall portion 26A seen in FIGS. 13, 18, 21, 24, 26, 29, 31, 34, 36, 39, 41, and 45. The end seal is conveniently sealed by sonic welding although heat welding, plasma welding or suitable adhesives can also be used. The planar back side 22 of the razor attachment unit 10 is secured to the end seal 118 of the semi-rigid tube 112 in the attachment area 122 (shown in cross hatching in FIGS. 9 and 47) by sonic welding, heat welding, plasma welding an adhesive, or by a rivet passing through the hole 124 and a hole 126 in registration with hole 124. Sonic welding has been found to be quite satisfactory. The bulge of the flexible tube adjacent to the seal end 118 is accommodated in the scallop wall portion 26 (26A in FIG. 47) of the razor blade attachment unit 10 which permits the planar back is side 22 of the razor blade attachment unit 10 to be somewhat in plane or somewhat parallel with the longitudinal axis of the semi-rigid tube 112. This positions the razor blade attachment plate 16 and the razor blade received therein correctly with respect to the semi-rigid tube handle 112. The angle A is preferably about 25°±5°. Although the scallop wall portion can be secured to the outer wall of the flexible tube, it has not been found necessary by the applicant and such attachment is optional. The hole 24 extends through the razor blade attachment unit 10 as described above and through the hole 126 in the head portion 120 and the end seal 118. This hole can be utilized for hanging the razor 110 on hooks in retail establishments for display and presentation for purchase, or it can receive a rivet or other securing attachment to secure the unit 10 to the flexible tube 112.

Although it is anticipated that the unit will be sold with a razor blade attached, the razor can be sold and transported or stored without a razor blade secured to the razor blade attachment plate 16. When the razor is to be utilized, a razor blade 40 can be slide on to the plate 16 in the conventional manner. The plate can be designed to detachably lock and secure the razor blade 40 on to the plate. When an operator wishes to replace the razor blade, take the razor blade out for any reason, the razor blade 40 can be slid off the plate 16. The attachment plate 16 can also be designed to permanently receive a razor blade which would prevent removal of the razor blade from the plate 16. In the razor blade illustrated in FIG. 6, the razor blade has three blades 42. Some razor blades have a single blade, others have two or more blades, and they can also be utilized on the present razor 110.

Figure 11:
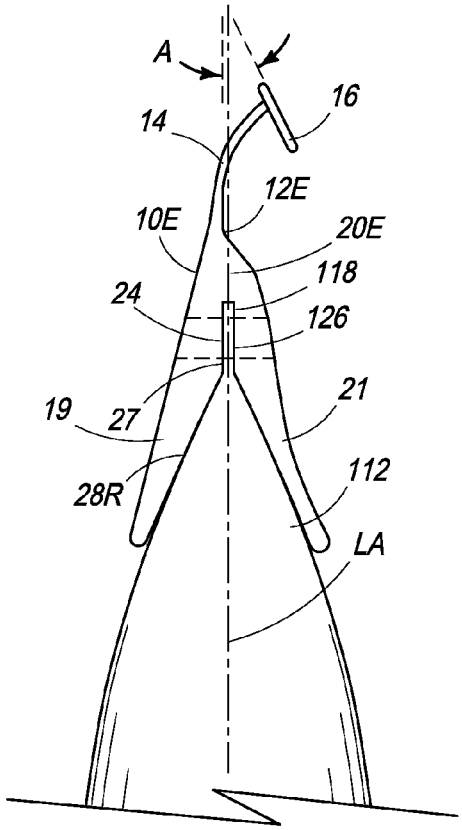
FIG. 11 is an enlarged fragmentary plan side view of the end portion of another embodiment of the applicator head attached to the flexible tube, similar to FIG. 10.
Figure 12:
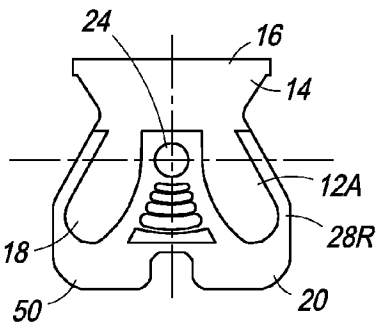
FIG. 12 is a front plan view of a razor blade attachment unit of the present invention.
Figure 13:
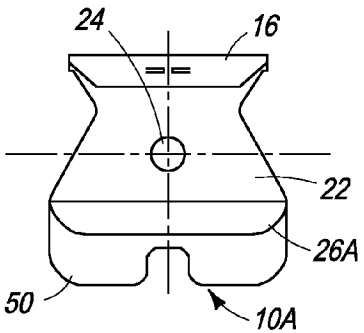
FIG. 13 is a back plan view of the razor blade attachment unit of FIG. 12.
Figure 14:
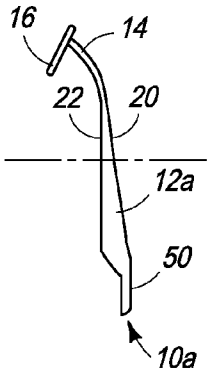
FIG. 14 is a left plan side view of the razor blade attachment unit of FIG. 12.
Figure 15:
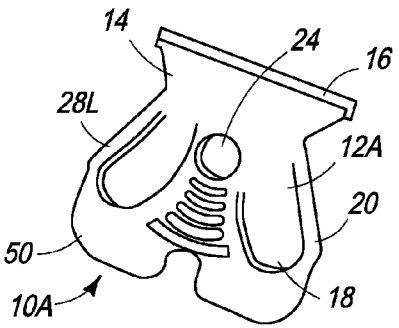
FIG. 15 is a front perspective view of the razor blade attachment unit of FIG. 12.
Figure 16:
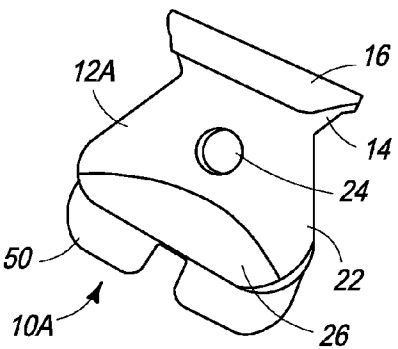
FIG. 16 is a back perspective view of the razor blade attachment unit of FIG. 13.

Referring to FIG. 11, another embodiment of the razor of the present invention is illustrated. The elements of this embodiment, which are identical to the elements of the razor shown in FIGS. 9 and 10, have the same drawing numbering. The razor attachment 10E has a front wall 21 extending from the frame 12B and a slot 27 is formed between the back wall 19 and the front wall 21. The slot 27 is adapted to securely receive the sealed end 118 of the flexible tube 112 in a friction fit or pinch fit. The walls of the slot 27 can have protrusions or teeth (not shown) to firmly grip the sealed end 118 to prevent the razor attachment unit 10 from being removed from the flexible tube 112. Additionally, the razor attachment unit can be secured to the sealed end by sonic welding, heat welding, plasma welding, or adhesive between the walls of the slot and the sealed end, or by a rivet passing through the hole 124 and a hole 126 in the sealed end which is in registration with hole 124.

Referring to FIGS. 12-16, another alternative embodiment of the razor attachment unit 10A is illustrated. The elements of the razor attachment unit 10A which are identical to the elements of razor attachment unit 10 are shown with the same drawing numbers. The principal difference between the razor attachment unit 10A from that of razor attachment unit 10 is the addition of the extended braces or supports 50 which extend down from the front of the frame 12A to provide further to support of the razor attachment unit with respect to the flexible tube 112 (see FIG. 10). When force is applied to the razor attachment 16, such as during shaving, the attachment between unit 10 and the sealed end 118 acts as a pivot point and the arm between the point of attachment and the razor attachment head 16 acts as a fulcrum or lever arm which forces the bottom portion of the frame 12 against the side of the flexible or semi-rigid tube 112 which could collapse the side of the tube which could render the tube's effectiveness as a tool handle. The braces or support 50 of the razor attachment unit 10 FIGS. 12-16 increases the surface area of the bottom portion of the frame 12A and braces the frame and resists pivoting of the frame at the point of attachment of the frame and the sealed end, and forcing the bottom of the frame into the side of the tube.

The flexible tubes 112 are made of plastic such as polyethylene and polypropylene. The flexible tubes can be co-extruded tubes which are multilayered tubes made of plastic and/or meal. These tubes can be made in a variety of flexibilities from being very flexible to being semi-rigid. In fact, they can be made quite rigid. But rigid wall tubes are undesirable because they can make it difficult, if not impossible, to dispense the contents therein, especially for thick compositions.

Thus, it is anticipated that the attachment will be used on either flexible or semi-rigid tubes. For flexible wall tubes, the movement or pivoting of the razor attachment unit with respect to the sealed end is a minor problem when the tube is filled with content. However, when a third or more of the contents have been evacuated from the tube, the razor attachment unit with sufficient force can partially or fully collapse the side of the tube as the unit pivots at the point of attachment as the razor is used. The razor attachment unit 10A has less of a tendency to pivot and collapse the side of the tube than the razor attachment unit 10 when used on a partially filled flexible tube.

Figure 19:
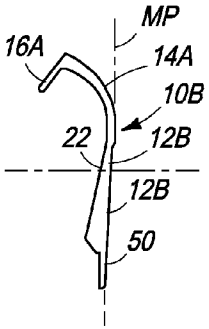
FIG. 19 is a left plan side view of the cosmetic scraper unit of FIG. 17.
Figure 18:
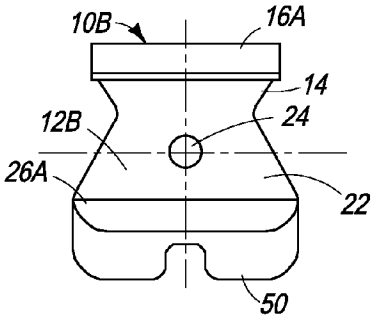
FIG. 18 is a back plan view of the cosmetic scraper unit of FIG. 17.
Figure 17:
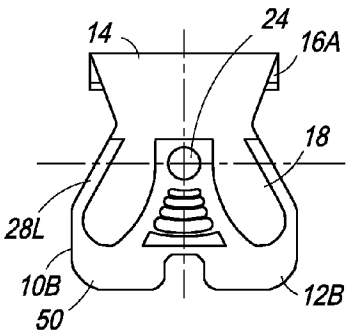
FIG. 17 is a front plan view of a cosmetic scraper unit of the present invention.

Referring to FIGS. 17-19, the attachment unit can be designed for a variety of purposes. The unit shown in FIGS. 17-19 is a cosmetic scraper attachment unit used for scraping surfaces. The scraper head 16A will be integral with the scraper is attachment unit 10B. The scraper head 16A can have a blunt edge or a knife-edge edge or an edge in between. The components or elements of scraper attachment unit 10B, which are identical to the same elements in razor attachment unit 10, are identified with the same drawing numbers. The scraper head 16A can be utilized for a number of applications. It is contemplated using the scraper attachment unit 10B with a tube 112 containing a depilatory agent for removal of hair from the body. The depilatory agent will be applied to the surface of the skin which bears the unwanted hair, allowed to work depilate the hair and then the composition and the depilated hair will be removed by employing the scraper to scrape off the composition and the depilated hair. After the operation is complete, hair and composition adhering to the scraper head 16A can be easily removed with water to leave a clean scraper attachment unit. The resiliency of the neck 14A can be adjusted either in thickness and/or in the composition used to manufacture the scraper attachment unit so that the semi-rigid neck that has sufficient resiliency so that the scraper head rides over imperfections on the surface of the skin.

Figure 22:
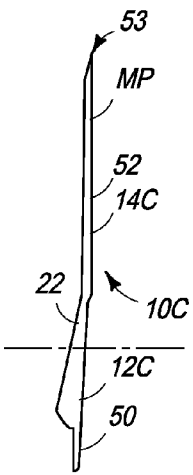
FIG. 22 is a left plan side view of the planar blade attachment unit of FIG. 20.
Figure 21:
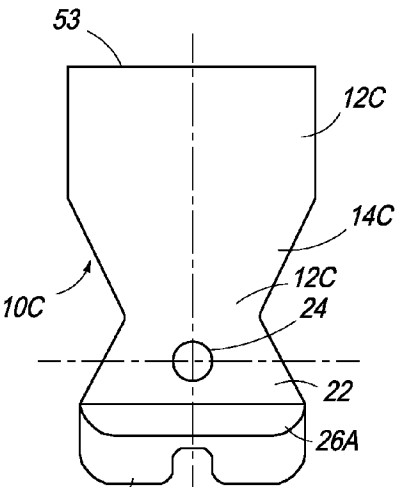
FIG. 21 is a back plan view of the planar blade attachment unit of FIG. 20.
Figure 20:
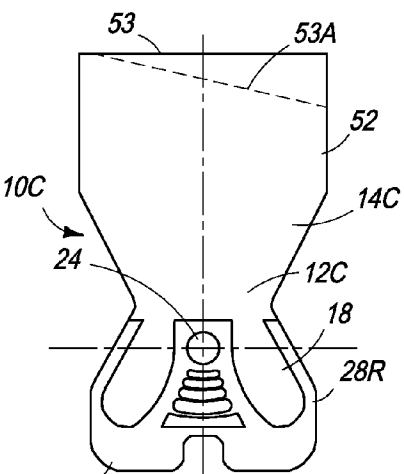
FIG. 20 is a front plan view of a planar blade attachment unit of the present invention.
Figure 25:
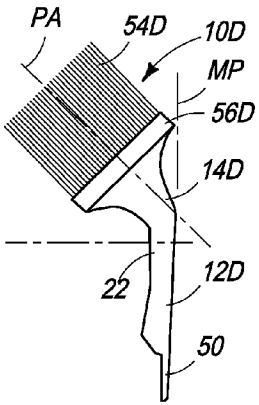
FIG. 25 is a left plan side view of the brush attachment unit of FIG. 23.
Figure 27:
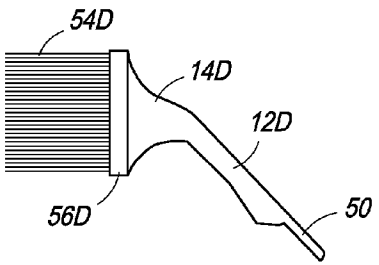
FIG. 27 is another left plan side view of the brush attachment unit of FIG. 23.
Figure 24:
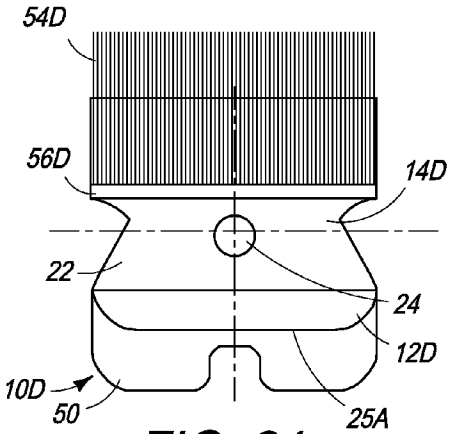
FIG. 24 is a back plan view of the brush attachment unit of FIG. 23.
Figure 26:
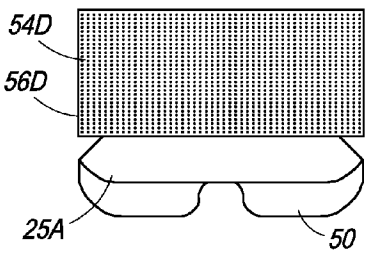
FIG. 26 is a top view looking down into the bristles of brush attachment unit of FIG. 25.
Figure 23:
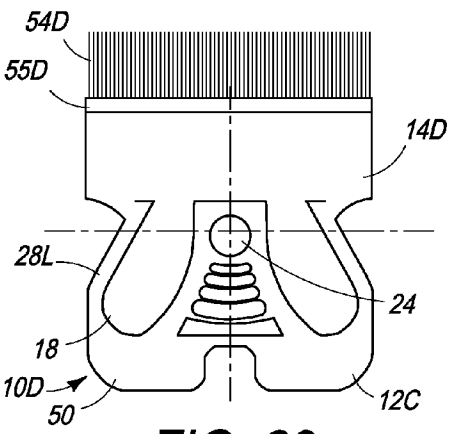
FIG. 23 is a front plan view of a brush attachment unit of the present invention.
Figure 35:
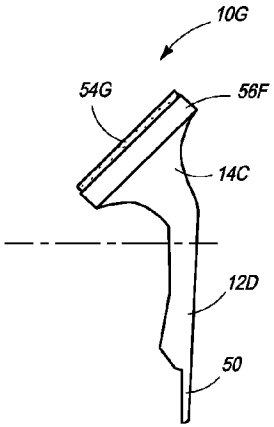
FIG. 35 is a left plan side view of the sandpaper/polishing pad attachment unit of FIG. 33.
Figure 34:
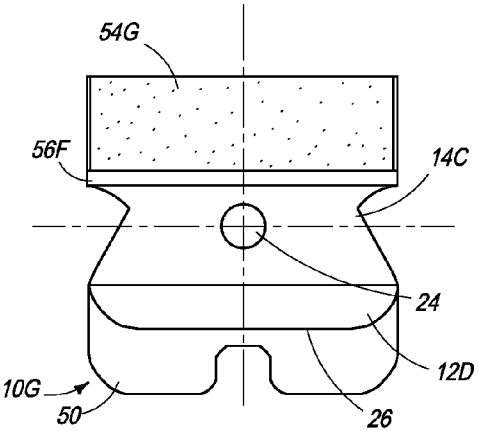
FIG. 34 is a back plan view of the sandpaper/polishing pad attachment unit of FIG. 33.
Figure 33:
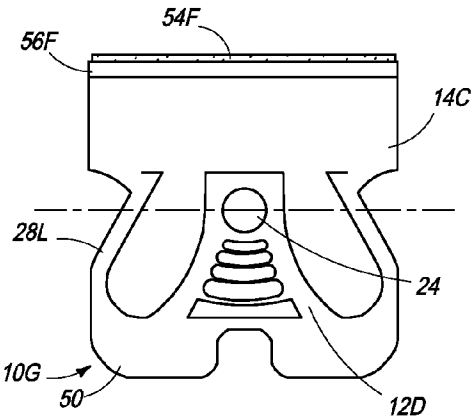
FIG. 33 is a front plan view of a sandpaper/polishing pad attachment unit of the present invention.
Figure 37:
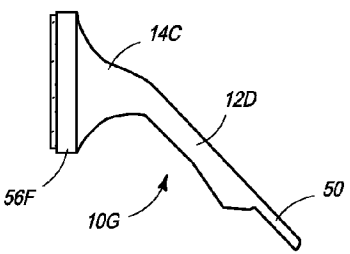
FIG. 37 is another left plan side view of the a sandpaper/polishing pad attachment unit of FIG. 33.
Figure 36:
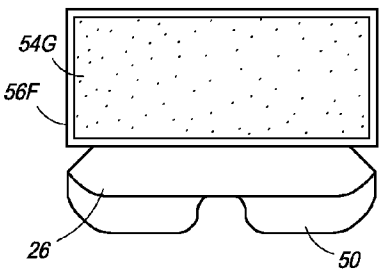
FIG. 36 is a top view looking into the sandpaper/polishing pad attachment unit of FIG. 35.
Figure 43:
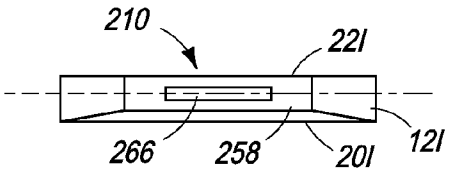
FIG. 43 is a top end view of the tool unit of FIG. 44.
Figure 44:
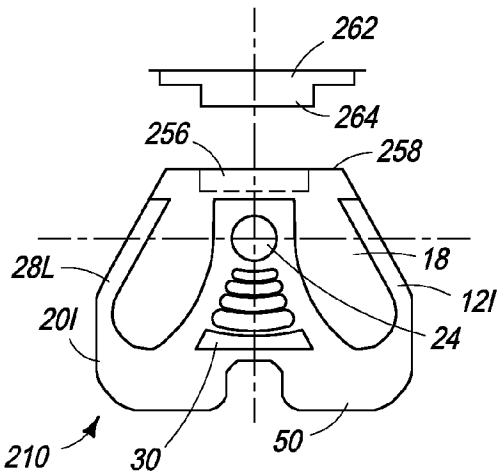
FIG. 44 is a front plant view of the tool attachment unit of the present invention.
Figure 45:
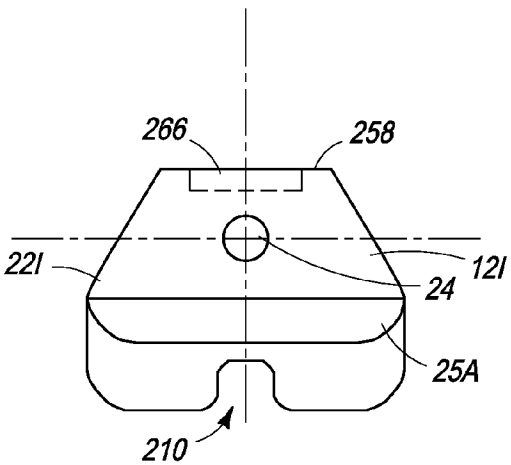
FIG. 45 is a back plan view of the tool unit of FIG. 44.
Figure 46:
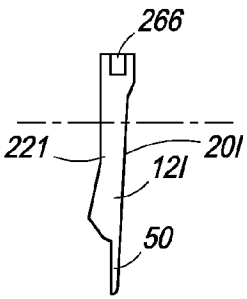
FIG. 46 is a left side of the tool attachment unit of FIG. 44.

Referring to FIGS. 20-22, a planar blade attachment unit 10C is illustrated. The elements of the blade attachment unit 10C and the razor attachment unit 10, which are identical, have been identified by the same drawing numbers. With proper design and manufacture, the blade attachment unit 10C can be utilized as a scraper or a grouting blade 52. When the blade 10C is to be utilized as a grouting blade, the blade 52 will be relatively pliable or flexible and normally will have a blunt squared-off edge 53. When blade 10C is a grouting blade, it can be utilized to apply grout or filler from the flexible tube to cracks, holes and the like. When the blade 10C is to be utilized as a scraper, such as a scraper to remove paint or other materials, blade 52 will be relatively rigid and the edge 53 will be a sharp edge, like a knife-edge, or a squared-off edge 53 with sharp edges and corners. When blade attachment unit 12C is a grouting blade, the grout will be stored within the flexible tube. In use, the grouting material will be dispensed from the tube into the crack or hole and the grouting material will be forced into the crack or hole and smoothed with respect to the surface surrounding the crack or hole employing the grouting blade 52. When the blade attachment unit 12C is a scraper, the flexible tube will contain composition used to soften, lift or remove material, such as paint, label adhesive, tar, and the like. The composition will be dispensed from the tube onto the material that is to be softened or removed. The composition is given sufficient time to work on the material, then the material is scraped off employing the scraper blade 52. The scrapers are illustrated with working ends perpendicular to the longitudinal axis of the blade. The working edge can be angled 53A (in phantom FIG. 20) to the longitudinal axis of the blade.

Referring to FIGS. 23-27, a brush attachment unit 10B is illustrated. The elements of the brush attachment unit 10B, which are common with the razor attachment unit 10, are identified by the same figure numbers. The brush attachment unit 10B has a bristle support plate 56 on which bristles 54 are supported. The bristles support plate 56 is connected to the frame 12C by the rigid neck 14C. The bristles can be molded into or with the bristle support plate at the same time the brush attachment unit frame is molded, or they can be added later. The bristles can be plastic, fiber, metal, or the like. In one embodiment, the bristles and bristles support plate 56 are manufactured separately and secured to the neck 14C by sonic welding, heat welding, adhesive, or the like. The bristles can be stiff or they can be flexible, depending upon the intended use of the brush attachment unit. One use is for cleaning wherein the tube 112 contains a cleaning composition which is dispensed onto the area to be cleaned and the cleaning composition is worked into the area that is to be cleaned, such as a spot on a fabric or rug, to remove a spot. A brush attachment unit can also be employed to coat a surface with composition contained in the tube, such as a protective coating, paint, ink, and the like.

Referring to FIGS. 33-37, a sandpaper/polishing pad attachment unit 10G is illustrated. The elements of the sandpaper/polishing attachment unit 10G which are common with the razor attachment unit 10, are identified by the same drawing or figure numbers. The sandpaper/polishing pad attachment unit 10G has a support plate 56A which supports the sandpaper or polishing pad. The sandpaper or polishing pad can be secured permanently to the support plate 56F, or they can be attached by an adhesive layer on the back of the sandpaper or pad. In that event, the sandpaper or polishing pad can be removed from the support plate and replaced with a fresh sandpaper or polishing pad when the need arises. Sandpaper comes in many grades, such as a very rough grade 10 and a very fine grade 1200. For the removal of paint or the like, a very rough grade is utilized. For a very fine finish, a very fine paper is used, such as the 1200 grade. The polishing pad can be a natural fiber pad such as a cotton or wool pad, a synthetic fiber pad such as a polyester or nylon pad, or it can be a smooth fiber-reinforced paper pad, or the like. The support plate 56F is connected to the frame 12D by the rigid neck 14D. The support plate can have a planar surface or a curved surface (not shown) and it can be rigid or resilient or flexible. In one embodiment, the support plate 56A can be manufactured separately and secured to the neck 14D by sonic welding, heat welding, adhesive, or the like.

Referring to FIGS. 38-42, a massage attachment unit 10H is illustrated. The elements of the massage attachment unit 10H, which are common with the razor attachment unit 10, are identified by the same figure numbers. Massage attachment unit 10H has a support plate 56F on which a massage head 54H is attached. Massage head 54H has a plurality of protrusions 57 for massaging tissue, especially the skin. Protrusions 57 come in a variety of sizes and shapes. Protrusions can be teeth-like with blunt heads and the teeth can be relatively flexible or inflexible (not shown), the protrusions can be elongated thick bristle-like structures (not shown), protrusions 57 can be half-round protrusions as illustrated in FIGS. 38-42, and the like. The support plate 56F is connected to the frame 12D by the rigid neck 14D. The massage head 54H normally is made of an elastomeric relatively soft material. The support plate can have a rectangular footprint as shown, or a round, square, oval, and the like, footprint. The support plate can have a planar surface or a curved surface (not shown) and it can be rigid or resilient or flexible. The massaging head 54H can be molded at the same time the massaging attachment unit frame is molded, or it can be molded with the support plate 56F as a separate unit distinct from the frame 12D, or it can be added later to the support plate 56 with adhesive. In the latter case, the massage head can be permanently attached to the support plate, or it can be removably secured to the support plate with a non-hardening adhesive coating on the back of the massage head. In that case, the massage head can be removed and replaced with another massage head as the need arises, such as to change the shape of the massage head for a different type of massaging action.

Referring to FIGS. 43-47, a universal implement attachment unit 210 for flexible tubes is illustrated. The elements of the attachment unit 210, which are identical to the elements of the razor attachment unit 10, are illustrated with the same drawing numbers. The attachment unit 210 has a top portion 258 with a female receptacle 266 which is adapted to receive the male extension 264 of the implement 262. The female receptacle 266 receive the male extension 264 either in a permanent locked position or in a removable secured position depending upon the intent of the user. The tool can be any of the implements shown in the preceding figures, including a razor attachment, a scraper, a blade, a brush, massager, a sponge applicator, a sandpaper/polishing pad, and the like. The tool can be received by the attachment unit 210 by securing the male extension 264 of the tool implement 262 into the female receptacle 266 of the attachment unit 210. The working end of the implement can be a razor attachment, a blade, a cosmetic scraper, a brush, massager, sandpaper/polishing pad, and the like.

As discussed above, the razor blade attachment plate is offset 25 degrees plus/minus 5 degrees to the longitudinal axis of the flexible tube (FIGS. 10-11). The cosmetic scraper is offset 30-90 degrees with respect to the main plane MP of the attachment unit and/or the longitudinal axis LA of the flexible tube. The sealed end of the tube is planar and lies in or is parallel to the longitudinal axis of the flexible tube. The planar backside 22 of the frame 12 is normally parallel to or intersected by the longitudinal axis of the flexible tube since the planar backside is secured to the sealed end. The planar scraper blade and the planar grouting blade FIGS. 20-22 are roughly parallel with respect to the main plane MP of the attachment unit 10C and/or intersects or is parallel to the longitudinal axis LA of the flexible tube. Although the planar blade tool is normally planar with respect to the longitudinal axis of the flexible tube, the blade can be offset from the longitudinal axis LA, such as angled out 45 degrees if so desired. The support plates for the attachment units 10D, 10F, 10G, and 10H are normally offset around 45 degrees plus/minus 15 degrees from the main plane MP and/or longitudinal axis LA. That is, a perpendicular axis PA passing through the support plate (see FIG. 25) is 45 degrees to the longitudinal axis LA of the flexible tube and/or the main plane MP of the frame plus/minus 15 degrees. However, the support plate can be perpendicular to the longitudinal axis LA of the flexible tube or the main plane MP of the frame depending upon the tool and how it is most effectively used.

As discussed above, the attachment units can be fixed to, or secured to, the sealed end of the flexible tube with welding (heat or sonic) forming a weldment boundary between the sealed end and the attachment unit, or with an adhesive or cement capable of bonding the attachment unit to the sealed end forming an adhesive or bonding film or layer between the sealed end and the attachment unit, or by a fastener[s] such as a rivet.

The invention has been described with specific embodiments but the spirit and intent of the invention is not limited to such specific embodiments. The specific embodiments have been used to illustrate some examples of the present invention but are intended to be limitations of the scope of the present invention.

The invention claimed is:

1. A razor blade holder for a flexible tube comprising:

a frame adapted to be secured to the longitudinally extending planar sealed end of the flexible tube having a longitudinal axis, the frame having an attachment portion with a bottom and a top wherein said top of the attachment portion is attached to a tool portion having a tool holder adapted to receive a razor blade, wherein the attachment portion has a hole extending through the frame for secure attachment of the frame to the longitudinally extending planar sealed end of the flexible tube, wherein the attachment portion has a planar back side and a front side comprising a first curved rib area on a left side of said attachment portion and a second curved rib area on a right side of said attachment portion, wherein a plurality of ribs extend between said first and second curved rib areas on said front side, and wherein each of said first curved rib area and said second curved rib area comprises a rib with a first end proximate to said tool portion that extends down the front side of the attachment portion substantially past said hole and towards the bottom of the attachment portion and curves back up said front side substantially past said hole and toward the tool portion.

2. The razor blade holder according to claim 1 wherein the frame is permanently affixed to the longitudinally extending sealed end of the flexible tube through said hole.

3. The razor blade holder according to claim 1 wherein the frame has at least one bore extending from the second surface through the frame to the first surface, and the longitudinally extending planar sealed end seal of the flexible tube has a bore coaxial with the bore in the frame; and a rivet received in the bores to secure the tool holder to the longitudinally extending planar sealed end seal of the flexible tube.

4. The razor blade holder according to claim 1 wherein the tool holder is adapted to permanently receive the razor blade.

5. The razor blade holder according to claim 1 wherein the tool holder is adapted to removably receive a razor blade.

6. The razor blade holder according to claim 1 wherein the tool portion of said frame has an arm extending upwardly and outwardly from the top of the attachment portion of said frame and a razor blade attachment plate secured to the end of the arm.

7. The razor blade holder according to claim 1 wherein the attachment portion is parallel to the longitudinal axis of the flexible tube.

8. The razor blade holder according to claim 1 wherein the razor blade received on the tool portion is at an angle of between 20 and 30 degrees to the longitudinal axis of the flexible tube.

9. The razor blade holder according to claim 1 wherein the frame has a wall extending downwardly and outwardly from the first surface and a slot between the first surface and the back side of the wall adapted to receive the longitudinally extending planar sealed end seal.

10. A shaver comprising:

a flexible tube having a longitudinal axis and a longitudinally extending planar sealed end, the planar sealed end parallel to the longitudinal axis of the flexible tube; and a razor blade cartridge holder comprising a frame adapted to be secured to the longitudinally extending planar sealed end of the flexible tube, the frame having an attachment portion with a bottom and a top wherein said top of the attachment portion is attached to a tool portion, having a tool holder adapted to receive a razor blade, wherein the attachment portion has a hole extending through the frame for secure attachment of the frame to the longitudinally extending planar sealed end of the flexible tube, wherein the attachment portion has a planar back side and a front side comprising a first curved rib area on a left side of said attachment portion and a second curved rib area on a right side of said attachment portion, wherein a plurality of ribs extend between said first and second curved rib areas on said front side and wherein each of said first curved rib area and said second curved rib area comprises a rib with a first end proximate to said tool portion that extends down the front side of the attachment portion substantially past said hole and towards the bottom of the attachment portion and curves back up said front side substantially past said hole and toward the tool portion.

11. The shaver according to claim 10 wherein the frame is permanently affixed to the longitudinally extending planar sealed end of the flexible tube through the hole.

12. The shaver according to claim 10 wherein the frame has a bore extending from the first surface through the frame, and the longitudinally extending planar sealed end seal of the flexible tube has a bore coaxial with the bore in the frame, and a fastener received in the bores to secure the tool holder to the sealed end of the flexible tube.

13. The shaver according to claim 10 wherein the tool holder is adapted to permanently receive the razor blade.

14. The shaver according to claim 10 wherein the tool holder is adapted to removably receive a razor blade.

15. The shaver according to claim 10 wherein the tool portion comprises an arm extending upwardly and outwardly from the top of the attachment portion and a razor blade attachment plate secured to the end of the arm.

16. The shaver according to claim 10 wherein the attachment portion is parallel to the longitudinal axis of the flexible tube.

17. The razor blade holder according to claim 10 wherein the razor blade received on the tool portion is at an angle of between 20 and 30 degrees to the longitudinal axis of the flexible tube.

18. The razor blade holder according to claim 10 wherein the frame has a wall extending downwardly and outwardly from the first surface and a slot between the first surface and the back side of the wall adapted to receive the longitudinally extending planar sealed end seal.

19. An implement comprising:

a frame adapted to be secured to the sealed end of a flexible tube, the frame having an attachment portion with a bottom and a top wherein said top of the attachment portion is attached to a tool portion having a tool holder adapted to receive a tool, wherein the attachment portion has a hole extending through the frame for secure attachment of the frame to the sealed end of the flexible tube, wherein the attachment portion has a planar back side and a front side comprising a first curved rib area on a left side of said attachment portion and a second curved rib area on a right side of said attachment portion, wherein a plurality of ribs extend between said first and second curved rib areas on said front side, and wherein each of said first curved rib area and said second curved rib area comprises a rib with a first end proximate to said tool portion that extends down the front side of the attachment portion substantially past said hole and towards the bottom of the attachment portion and curves back up said front side substantially past said hole and toward the tool portion.

20. The tool holder according to claim 19 wherein the tool portion is a brush, planar scraper blade, cosmetic scraper, massager head, flexible planar blade, sponge applicator head, sandpaper head, or a polishing pad.

* * * * *